US005878308A

United States Patent [19]

Kurata et al.

[11] Patent Number: 5,878,308

[45] Date of Patent: Mar. 2, 1999

[54] IMAGE FORMING APPARATUS HAVING STRUCTURE FOR ADDING FUNCTIONS

[75] Inventors: Norimasa Kurata, Fukuyama; Tadasu Taniguchi, Uda-gun; Yasuo Ogawa; Akinari Nakagawa, both of Fukuyama, all of Japan

[73] Assignee: Sharp Kabushiki Kaisha, Osaka, Japan

[21] Appl. No.: 937,612

[22] Filed: Sep. 25, 1997

[30] Foreign Application Priority Data

Oct. 25, 1996 [JP] Japan ..... 8-2835325

[51] Int. Cl.[6] ..... G03G 15/00

[52] U.S. Cl. ..... 399/110; 399/107

[58] Field of Search ..... 399/107, 110, 399/126, 391, 393, 402; 271/9.01, 9.06, 9.11, 145, 163

[56] References Cited

U.S. PATENT DOCUMENTS

| | | | |
|---|---|---|---|
| 5,191,382 | 3/1993 | Okamura et al. | 399/107 |
| 5,379,101 | 1/1995 | Takahashi et al. | 399/110 |

FOREIGN PATENT DOCUMENTS

| | | |
|---|---|---|
| 5-270714 (A) | 10/1993 | Japan . |
| 6-202389 (A) | 7/1994 | Japan . |
| 8-1226 (Y2) | 1/1996 | Japan . |

*Primary Examiner*—Arthur T. Grimley
*Assistant Examiner*—Sophia S. Chen

[57] ABSTRACT

When replacing a small-volume sheet tray unit which is accommodated in an accommodation space of a base frame of an image forming apparatus body, with a large volume sheet tray unit, a sub-frame is integrally joined and fixed at a bottom of the base frame.

6 Claims, 14 Drawing Sheets

IMAGE FORMING APPARATUS HAVING STRUCTURE FOR ADDING FUNCTIONS

BACKGROUND OF THE INVENTION (1) Field of the Invention

The present invention relates to an image forming apparatus such as a laser printer, copier, facsimile machine and the like, in particular relating to an image forming apparatus in which a small volume sheet tray unit accommodated therein can be replaced as required by a duplex printing tray unit or a large volume sheet tray unit.

(2) Description of the Prior Art

In conventional image forming apparatuses such as copiers, the sheet tray for holding sheets or the original table portion for placing an original cannot be made smaller than a maximum size of sheets or original to be used, while various kinds of functional parts inside the image forming apparatus have been developed to be compact. As a result, the size of the footprint of the image forming portion including an image forming means and a fixing means when viewed from above has become approximately equal to the size of the sheet tray of the maximum-sized sheets.

There are demands for provision of multiple sheet trays which allow simultaneous setting of various kinds of sheets and for reducing the floor space (to be referred to hereinbelow as footprint) which an image forming apparatus occupies when it is installed.

For these reasons, image forming apparatuses have been developed to have a layered structure: that is, the scanner portion for scanning the original, the image forming portion (including an image forming means and fixing means) for forming an original image onto a sheet of paper, and a sheet tray portion for accommodating sheets are arranged in this sequential order from the top to the bottom.

In such image forming apparatuses having a layered structure, functional parts for various functions required for image forming, such as a scanner portion, image forming portion, fixing portion, sheet storage portion, sheet conveying portion and the like are formed as individual functional units so that the functions of the image forming apparatus can be easily changed by selecting the combination of the functional units to be assembled into a main frame for accommodating functional units.

For example, as shown in FIG. 1, the image forming apparatus in this case is made up of a machine body 11 having a scanner portion and an image forming portion and an accommodation for accommodating a sheet storage unit 12.

In an image forming apparatus of this type, it is possible to use a common frame for the sheet storage unit when a size of sheets is changed into another and hence inhibit the increase in cost of the product due to increase in the number of parts and the increase in the cost for dies. Nevertheless, if a duplex printing function needs to be added to an already purchased image forming apparatus, the duplex printing tray, which will have a different height, is forced to be placed under the sheet storage unit, and therefore the conveyance path becomes longer, giving rise a problem in that the job speed for duplex printing is degraded.

As a means for solving this problem, it is disclosed in Japanese patent Application Laid-Open Hei 5 No. 270,714 that a device for inverting and conveying sheets for duplex printing is detachably provided between the image forming unit inside the image forming apparatus body and the first sheet storage tray. This apparatus is configured so that this sheet inverting and conveying device can be detached from the image forming apparatus body and a second sheet storage tray having the same size as the sheet inverting and conveying device can be attached in place.

However, in the image forming apparatus of this type, the size of the sheet storage unit to be attached was limited, and therefore it was impossible by any means to attach a sheet storage unit greater than the original one.

An image forming apparatus shown in FIG. 2 is composed of a machine body 13 integrally having a scanner portion, an image forming portion and a plurality of sheet storage units 14*a*, 14*b* and 14*c* accommodated in respective frames 15*a*, 15*b* and 15*c* and stacked under machine body 13, separably from each other. Therefore, it is possible to easily change the variety and number of sheet storage units which are stacked under the upper unit (Japanese Utility Model Publication Hei 8 No. 1,226).

This image forming apparatus disclosed in Japanese Utility Model Publication Hei 8 No. 1,226, however, has a problem. That is, if various types of sheet storage units having different heights i.e., small volume sheet storage trays, large volume sheet storage trays, duplex printing trays, etc., are set, different sizes of large accommodation frames for the various storage units are needed and the dies for molding those accommodation frames increase the product cost.

SUMMARY OF THE INVENTION

The present invention has been devised in order to solve the above problems, and it is therefore an object of the present invention to provide an image forming apparatus such as a laser printer, copier, facsimile machine or the like, which can be easily added with additional functions as required by optionally attaching a duplex printing tray unit, small volume sheet tray unit and/or large volume sheet tray unit, and which can maximize the job speed of duplex printing in an already purchased machine.

In order to achieve the above object, an image forming apparatus in accordance with the first aspect of the invention is made up of a plurality of functional units assembled in combination, comprises a main frame having an accommodating portion having a predetermined accommodation space for accommodating a first functional unit, and characterized in that when a second functional unit which requires a greater accommodation space than that of the first functional unit is accommodated, a sub-frame which creates a greater accommodation space of the accommodating portion of the main frame for accommodating the second functional unit is jointed and fixed integrally to the main frame.

In order to achieve the above object, an image forming apparatus in accordance with the second aspect of the invention is characterized in that the first functional unit is a sheet storage tray for holding sheets; the second functional unit is a duplex printing tray unit; and a sub-frame for accommodating the second functional unit is jointed and fixed integrally to the main frame.

In order to achieve the above object, an image forming apparatus in accordance with the third aspect of the invention is characterized in that the sub-frame is joined integrally to the main frame of the image forming apparatus body, and when the duplex printing tray unit is attached thereto, an accommodation space for accommodating a sheet storage tray is formed below the duplex printing tray unit.

In order to achieve the above object, an image forming apparatus in accordance with the fourth aspect of the invention is characterized in that the sub-frame is formed by assembling side wall portions which are formed of rectangular bars and are connected to the sides of the main frame of the image forming apparatus body, with a rear side plate which is connected to the rear ends of the side wall portions.

In order to achieve the above object, an image forming apparatus in accordance with the fifth aspect of the invention is characterized in that when the sub-frame is joined to the main frame of the image forming apparatus body, with an openable front panel and sheet jam removal panel provided in the image forming apparatus body both open, the main frame and sub-frame are jointed in the vertical direction along the side of the panel hinges.

In order to achieve the above object, an image forming apparatus in accordance with the sixth aspect of the invention is characterized in that when the sub-frame has been integrally joined to the main frame of the image forming apparatus body and the duplex printing tray unit has been attached thereto, a sheet conveyance path for allowing the sheet with one side printed to proceed to the duplex printing tray unit is provided in the image forming apparatus body.

In order to achieve the above object, an image forming apparatus in accordance with the seventh aspect of the invention further comprises a pickup roller for sheet storage tray having a cover therefor and is characterized in that when the sub-frame has been integrally joined to the main frame of the image forming apparatus body and the duplex printing tray unit has been attached thereto, the surface of the cover for the pickup roller constitutes part of the guide surface for the duplex conveyance path of the sheet which is discharged from the duplex printing tray unit.

In accordance with the first configuration, when the first functional unit having a predetermined accommodation space is detached from the accommodating portion inside the image forming apparatus and the second functional unit which requires a greater accommodation space than that of the first functional unit is accommodated, the sub-frame is jointed integrally to the main frame of the image forming apparatus body so as to create a greater accommodation space of the accommodating portion which will allow the second functional unit to be fitted. Thus, this configuration attains two diverse objects, i.e., easy addition of new functions and avoidance of a large frame, making it possible to easily add new functions.

In accordance with the second configuration, since the main frame can be commonly used for the sheet storage tray and the duplex printing tray unit, it is therefore possible to minimize the length of the sheet conveyance path for duplex printing and hence achieve a higher job speed of the duplex printing operation when the duplex printing tray unit is attached than that when a duplex print tray unit is attached to other places.

In accordance with the third configuration, when the sub-frame is integrally joined to the main frame of the image forming apparatus body and the duplex printing unit is attached thereto, an accommodation space for accommodating the sheet storage tray is formed below the duplex printing tray unit. Therefore, it is possible to use the originally provided sheet storage unit in an integrated configuration, without it being idle.

In accordance with the fourth configuration, since the sub-frame is formed by assembling side wall portions with a rear side plate, the sheet storage tray before assembly can be easily carried when additional functions are added to an already marketed machine. Further, concerning storage of the parts on the production line, frames can be produced for each individual unit and need a minimum amount of space for storage. Moreover, since the sub-frame is formed by parts of extremely simple shapes, i.e., rectangular-bar shaped plates, packaging it for transport becomes simple.

In accordance with the fifth configuration, when the sub-frame is joined to the main frame of the image forming apparatus body, with an openable front panel and sheet jam removal panel provided in the image forming apparatus body both open, the main frame and sub-frame are jointed in the vertical direction along the side of the hinges of these panels. This configuration can provide the strength in both the vertical and horizontal directions which is high and hence increases the rigidity across the composite frame structure, and is suitable for the frame which is positioned at the bottom and supports the weight on the top thereof. Further, since only the joints appear between the main frame and the sub-frame, the composite presents a good appearance.

Moreover, since the main frame and sub-frame are joined and fixed by opening the jam-removal panel and front panel of the image forming apparatus body, which are both easily opened without using tools, the fixture can be made from above, which is simpler as compared to the configuration where the work of joining should be carried out by disassembling the front panel.

In accordance with the sixth configuration, when the sub-frame has been integrally joined to the main frame of the image forming apparatus body and the duplex printing tray unit has been attached thereto, the sheet conveyance path for allowing a sheet with one side printed to proceed to the duplex printing tray unit is provided inside the image forming apparatus. This configuration enables easy attachment and use of the duplex printing tray unit in place of the sheet storage tray.

In accordance with the seventh configuration , when the sub-frame has been integrally joined to the main frame of the image forming apparatus body and the duplex printing tray unit has been attached thereto, the surface of the cover for the pickup roller for sheet storage trays constitutes part of the guide surface for the re-conveyance path of the sheet which is discharged from the duplex printing tray unit. This configuration does not need disassembly of the pickup roller of the sheet storage tray when the function of duplex printing is added to a machine already on the market, therefore it is possible to easily add the function of duplex printing.

DESCRIPTION OF THE PREFERRED EMBODIMENTS

Figure 1:
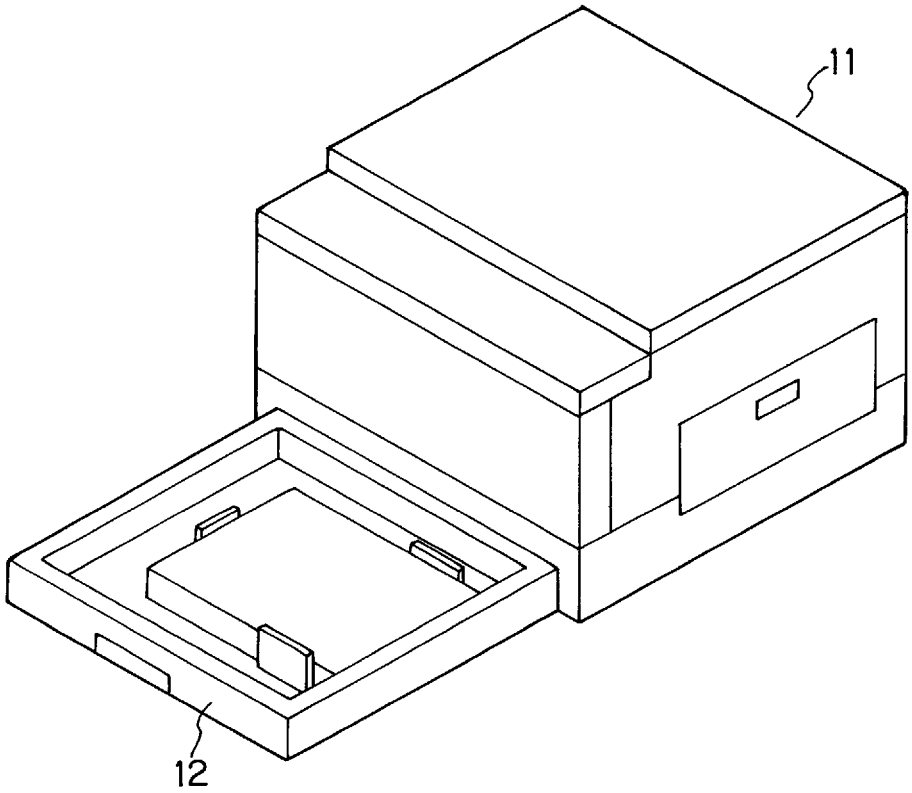
FIG.1 PRIOR ART
FIG. 1 is a perspective view showing how a sheet tray unit is fitted into a conventional image forming apparatus.
Figure 2:
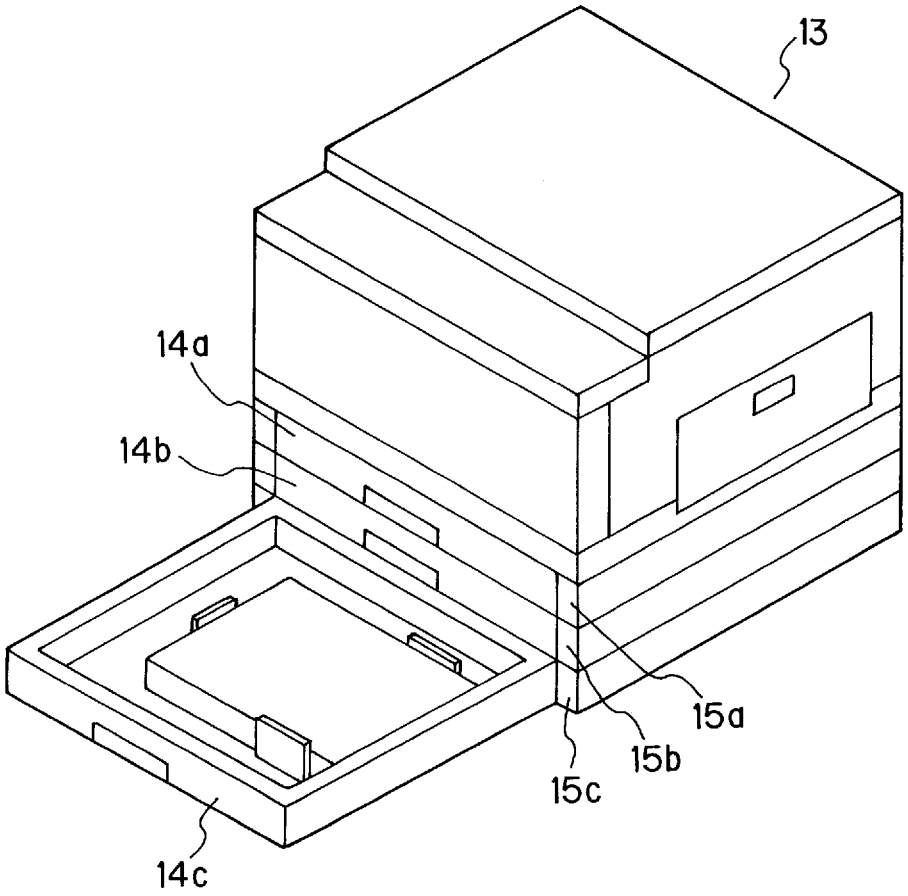
FIG. 2 PRIOR ART
FIG. 2 is a perspective view showing how a sheet tray unit is fitted into a conventional image forming apparatus.

The embodiment of the invention will be described with reference to FIGS. 3 through 15. The embodiment of the invention is an example in which three different types of sheet tray units, i.e., a duplex printing tray unit (110 in FIG. 3) as part of a functional unit, a small volume sheet tray unit (130 in FIG. 4) and a large volume sheet tray unit (150 in FIG. 7), are set in a common accommodation within an image forming apparatus body 100.

Figure 3:
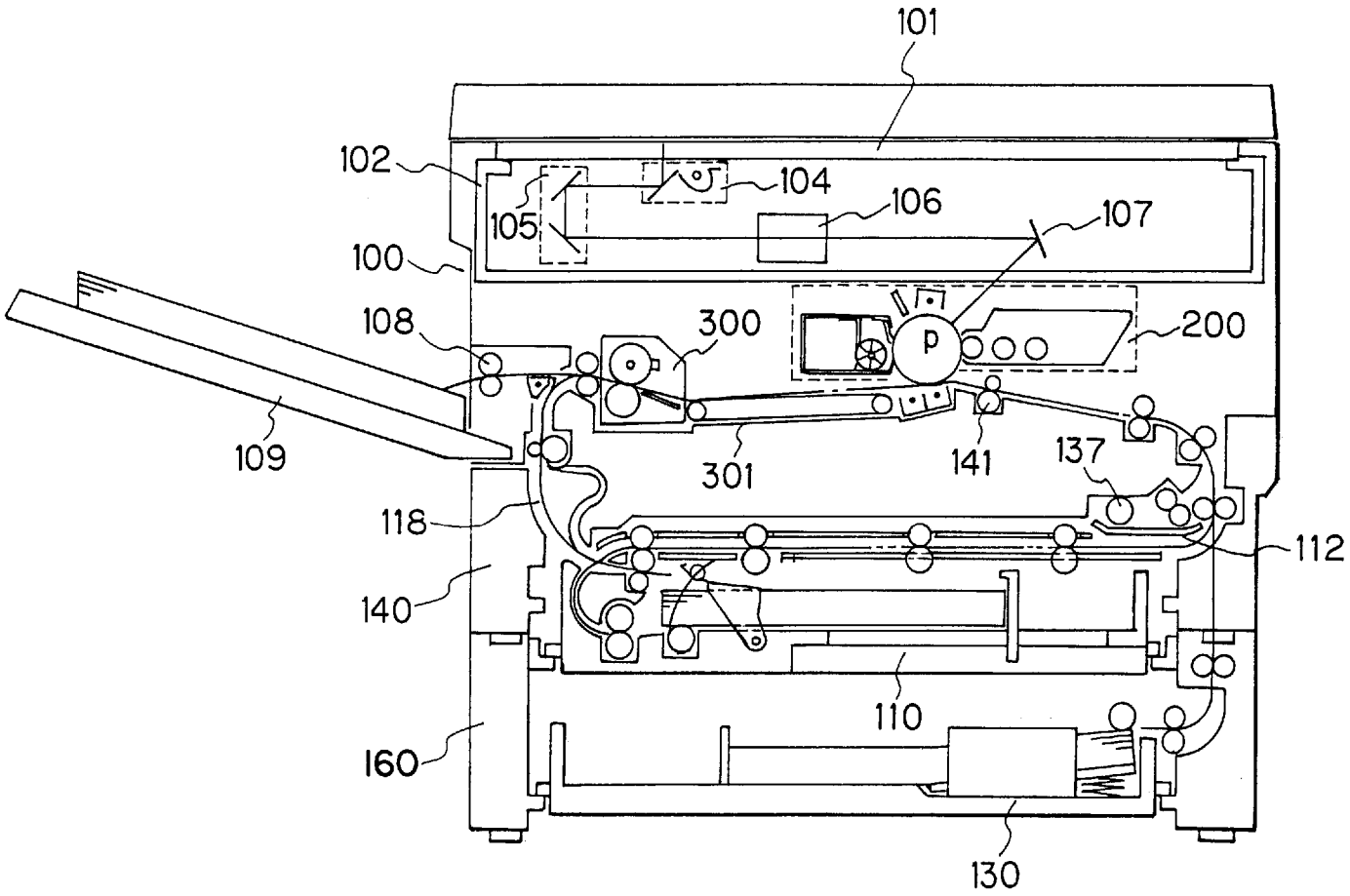
FIG. 3 is an overall configurational diagram schematically showing an image forming apparatus having a duplex printing tray unit of an embodiment in accordance with the invention.

As shown in FIG. 3, image forming apparatus body 100 includes, in its interior, an original scanner unit 102 having a scanning function for scanning the original placed on a contact glass 101 to obtain an original image; an image forming unit 200 disposed in the central portion thereof for forming the original image visually reproduced by the developing unit on a sheet of paper; and a fixing unit 300 having the function of fixing the toner image transferred to the sheet by image forming unit 200. Image forming apparatus 100 has, at its lower part, a base frame 140 as a main frame of the image forming apparatus and a sub-frame 160 integrally fixed to frame 140 so that a duplex printing tray unit 110 and a small volume sheet tray unit 130 for A4 and B5 size sheets below the unit 110 can be layered between. This duplex printing tray unit 110 causes the sheet having a printed image formed on the front surface thereof and having passed through fixing unit 300, to proceed from the upper part into duplex printing tray unit 110 and be stacked thereon and then conveys the lowermost sheet toward the sheet inversion conveying system and then into a sheet inverting unit in order to achieve printing on the rear surface of the sheet. Further, in order to feed a sheet of paper from small volume sheet tray unit 130, a sheet conveyance passage is formed in base frame 140 and sub-frame 160 on the side where a sheet feeder port is provided in small volume sheet tray unit 130.

To handle sheet feeding when small volume sheet tray unit 130 or a large volume sheet tray unit 150 is attached in place of duplex printing tray unit 110, a sheet pickup roller for sheet feeding (137 in FIG. 10) is provided. Since this sheet pickup roller 137 will not be needed when the duplex printing tray unit is attached, it is retracted inside a cover 112, which constitutes part of the guide for duplex conveyance passage of sheet delivered from the duplex printing tray unit.

Now, the configuration and operation of each unit will be described.

Original scanner unit 102 has a contact glass 101 disposed on the top part of the original scanner unit frame for having an original placed thereon, and includes, in the interior of the original scanner unit frame, an exposure lamp unit 104 integrally composed of an exposure lamp and a first mirror, a moving mirror unit 105 integrally composed of second and third mirrors, a zoom lens 106, and a fourth mirror 107.

The original scanning operation of original scanner unit 102 is performed by making exposure lamp unit 104 travel at a uniform speed from one end of the original placed on contact glass 101 to the other end whilst the exposure lamp illuminates the original. During this operation, moving mirror unit 105 moves in synchronism with the movement of exposure lamp unit 104 in the same direction as exposure lamp unit 104 at half the speed of that of exposure lamp unit 104. In this operation, the reflected light from the original propagates along an optical path created by the first, second and third mirrors, zoom lens 106 and fourth mirror 107, illuminating the photoreceptor at an exposure point P. In this way, a static latent image of the original can be formed on the surface of the photoreceptor. Here, exposure lamp unit 104 and moving mirror unit 105 are driven by the driving force transmitted through unillustrated pulleys and wire from an unillustrated mirror motor so as to reciprocate left and right in the figure.

An original cover which presses the original placed on contact glass 101 into contact therewith is provided on the top of original scanner unit 102, and its rear side is pivotally fixed by an unillustrated open/close hinge so that the cover can be lifted from the front side.

In image forming unit 200, provided around the photoreceptor are a developing unit, transfer charger, separation charger, cleaning unit, charge erasing lamp and main charger, arranged in this order to the downstream side of exposure point P.

Image forming operation by image forming unit 200 is implemented as follows.

First, the main charger gives charge to the surface of the photoreceptor which is rotated so as to uniformly electrify the photoreceptor surface. Then, when the surface of the photoreceptor which has been uniformly charged by the main charger reaches exposure point P, the reflected light from the original which is conducted through the exposure opening from the original scanner unit illuminates the photoreceptor surface and releases the charge on the uniformly charged photoreceptor surface, thus forming a static latent image corresponding to the original image. Subsequently, when the photoreceptor surface with this static latent image formed thereon moves to a position facing the developing portion of the developing unit, the developer having an opposite polarity is supplied from the developing unit to the charge of the static latent image, whereby the toner is attracted by the static latent image due to static force so that the static latent image is visualized into a toner image.

Next, the photoreceptor surface with a toner image formed thereon reaches a position facing the transfer portion of the transfer charger, charge of the same polarity as that on the surface of the photoreceptor is supplied to a sheet being fed. As the potential on the sheet put in close contact with the photoreceptor increases and becomes greater than the surface potential of the photoreceptor, the toner image on the surface of the photoreceptor is attracted to the sheet, that is, the toner image is transferred from the photoreceptor surface to the sheet.

Then, the separation charger adjacent to the transfer charger supplies charge of an opposite polarity to that supplied from the transfer charger so that the attraction between the photoreceptor surface and the sheet lowers. As a result, the sheet holding the toner image thereon, is separated from the photoreceptor surface.

Further, when the photoreceptor surface moves and reaches a position facing the cleaning unit, leftover toner which has not transferred to the sheet during transferring and remains on the photoreceptor surface is removed therefrom.

When the photoreceptor surface cleaned of the leftover toner reaches a position facing the charge eraser lamp, erasing light radiated from the eraser lamp reduces the surface potential of the photoreceptor to a substantially uniform low level of voltage, thus preventing the surface potential of the photoreceptor from being raised too high or losing uniformity when the photoreceptor is charged by the main charger. The steps described above are sequentially implemented so that the image of the scanned original is formed into a toner image on a sheet of paper.

Fixing unit 300 mainly comprises: a heat roller made up of a metal pipe such as aluminum or the like and a heat-resistant, nonadhesive resin coated thereon; a pressure roller made up of a metal core and a heat-resistant, elastic layer made up of silicone rubber or the like formed thereon; a heater lamp as a heat source disposed inside the heat roller for heating; a temperature detector such as a thermistor or the like disposed in contact with the outer periphery of the heater lamp for keeping the heater lamp at a prescribed temperature; separation claws put in contact with the outer periphery of the heat roller or pressure roller for separating the sheet of paper from the heat roller or pressure roller; and a pressing means for pressing the pressing roller against the heat roller.

The fixing operation of the fixing unit 300 is implemented as follows.

Figure 4:
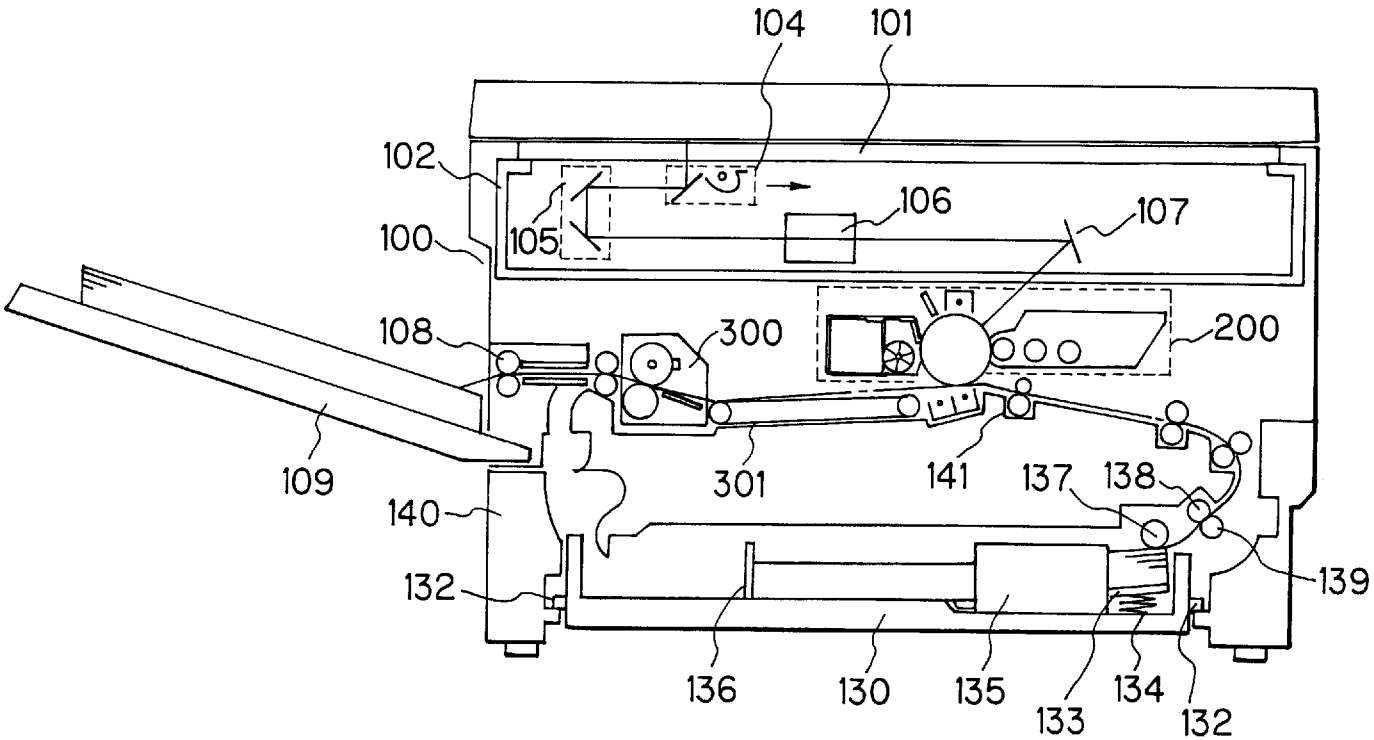
FIG. 4 is an overall configurational diagram schematically showing an image forming apparatus having a small volume sheet tray unit in accordance with an embodiment of the invention.
Figure 5:
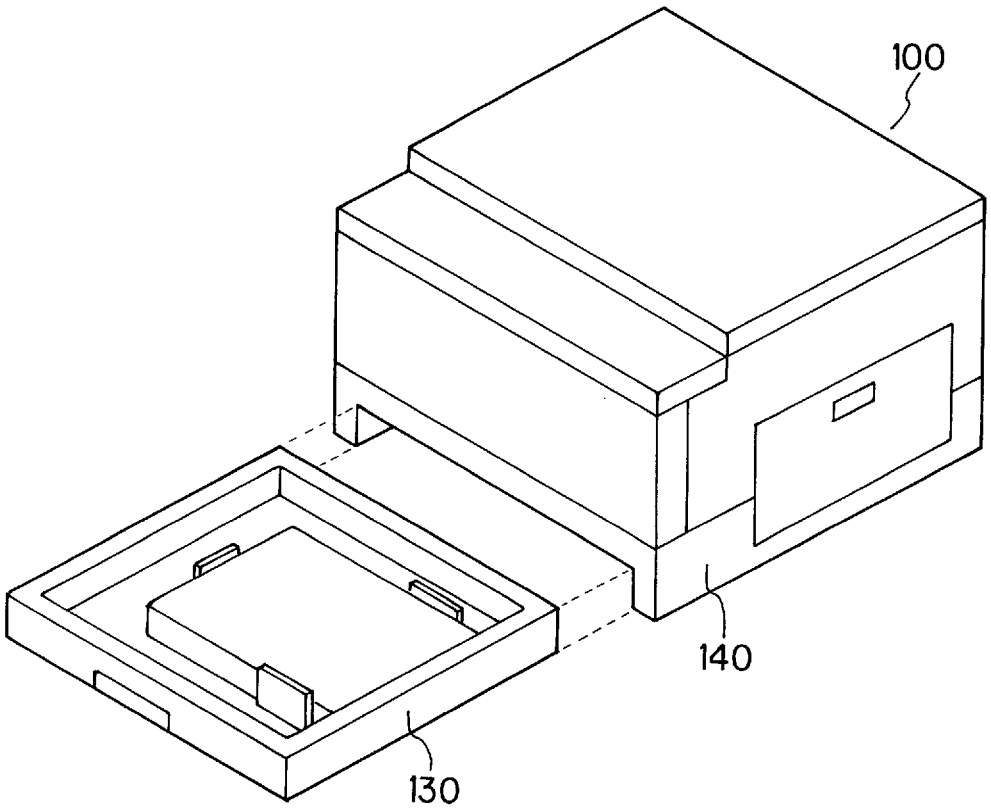
FIG. 5 is a perspective view showing how the small volume sheet tray unit is fitted into the aforementioned image forming apparatus.
Figure 6:
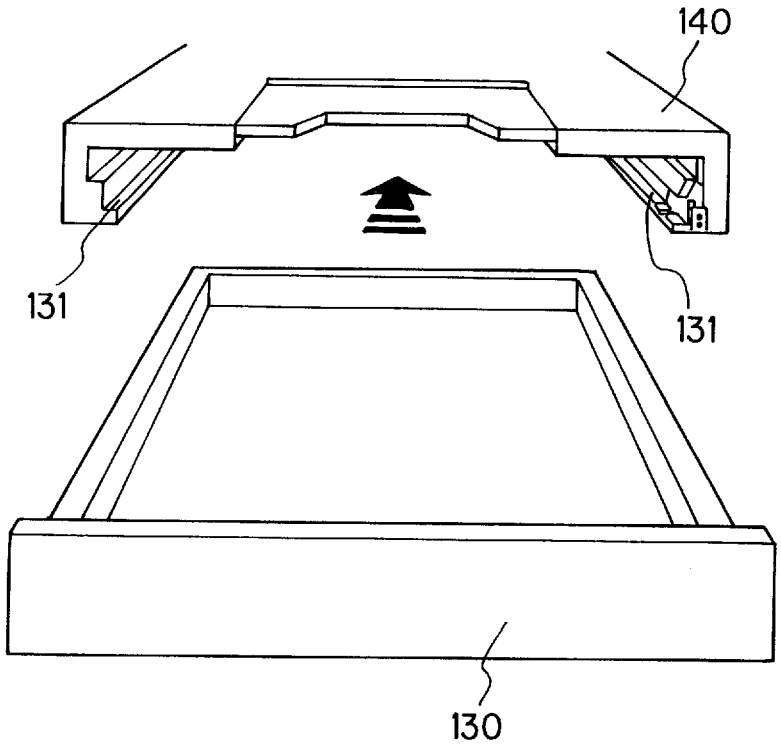
FIG. 6 is a perspective view showing the positions of rails along which the small volume sheet tray unit is fitted into the aforementioned image forming apparatus.

The sheet of paper having the toner image, formed by image forming unit 200, adhering thereto but unfixed thereon is conveyed by a sheet conveyer belt 301 to the nip between the heat roller and pressure roller which are pressed to each other. During the passage of the sheet through the nip, the sheet is heated and pressed so that the unfixed toner image is fixed to the paper. Thereafter, the paper is separated by the separation claws. The thus separated sheet with one side printed is conveyed through a sheet conveyance passage 118 to be guided to the duplex printing tray unit 110 and stacked thereon when the rear side of the paper needs to be printed. As shown in FIGS. 4 through 6, image forming apparatus body 100 is designed so that small volume sheet tray unit 130 which can accommodate about 250 sheets and is formed separately from image forming apparatus body 100 can be detachably attached as an optional tray in place of duplex printing tray unit 110. FIG. 6 is a perspective view showing how small volume sheet tray unit 130 is fitted into image forming apparatus body 100.

Next, the structure of this small volume sheet tray unit 130 will be described in detail.

Small volume sheet tray unit 130 is designed so that it can be accommodated in the place from where duplex printing tray unit 110 has been drawn along rails 131 from image forming apparatus body 100.

Since small volume sheet tray unit 130, unlike duplex printing tray unit 110, has no sheet inverting and conveying device and hence the setting of tray unit 130 needs less height, sub-frame 160 is separated from base frame 140 of the image forming apparatus. This configuration facilitates carriage and transport because the image forming apparatus having small volume sheet tray unit 130 attached therein is lighter.

Small volume sheet tray unit 130 has projected portions 132 on the left and right sides of the frame thereof, which engage rails 131 of image forming apparatus body 100. Provided in the frame of unit 130 are a pressure plate 133 for receiving sheets, a pressure plate spring 134, a width adjuster plate 135 and rear end adjuster plate 136. Width adjuster plate 135 and rear end adjuster plate 136 are provided movably in accordance with the size of paper accommodated so that the sheets placed will not be displaced. The sheets placed on the pressure plate 133 are urged against an aftermentioned feed roller by means of pressure plate spring 134.

The paper held in small volume sheet tray unit 130 is picked up by pickup roller 137 to a pair of rollers, i.e., feed roller 138 and separation roller 139, and then is separated sheet by sheet and conveyed thereby. The front edge of the sheet is aligned with the axial direction of the photoreceptor, by a pair of resist rollers 141, and then the sheet is delivered out toward the photoreceptor in synchronization with the toner image formed on the photoreceptor surface. The sheet with the toner image transferred from the photoreceptor is separated from the photoreceptor surface by the separation charger, and then is conveyed toward fixing unit 300 by means of sheet conveyer belt 301. After the fixing step, the sheet delivered out from fixing unit 300 passes through conveyance rollers and then is discharged onto a sheet output tray 109 provided outside the image forming apparatus by means of a paper discharging roller 108.

Figure 7:
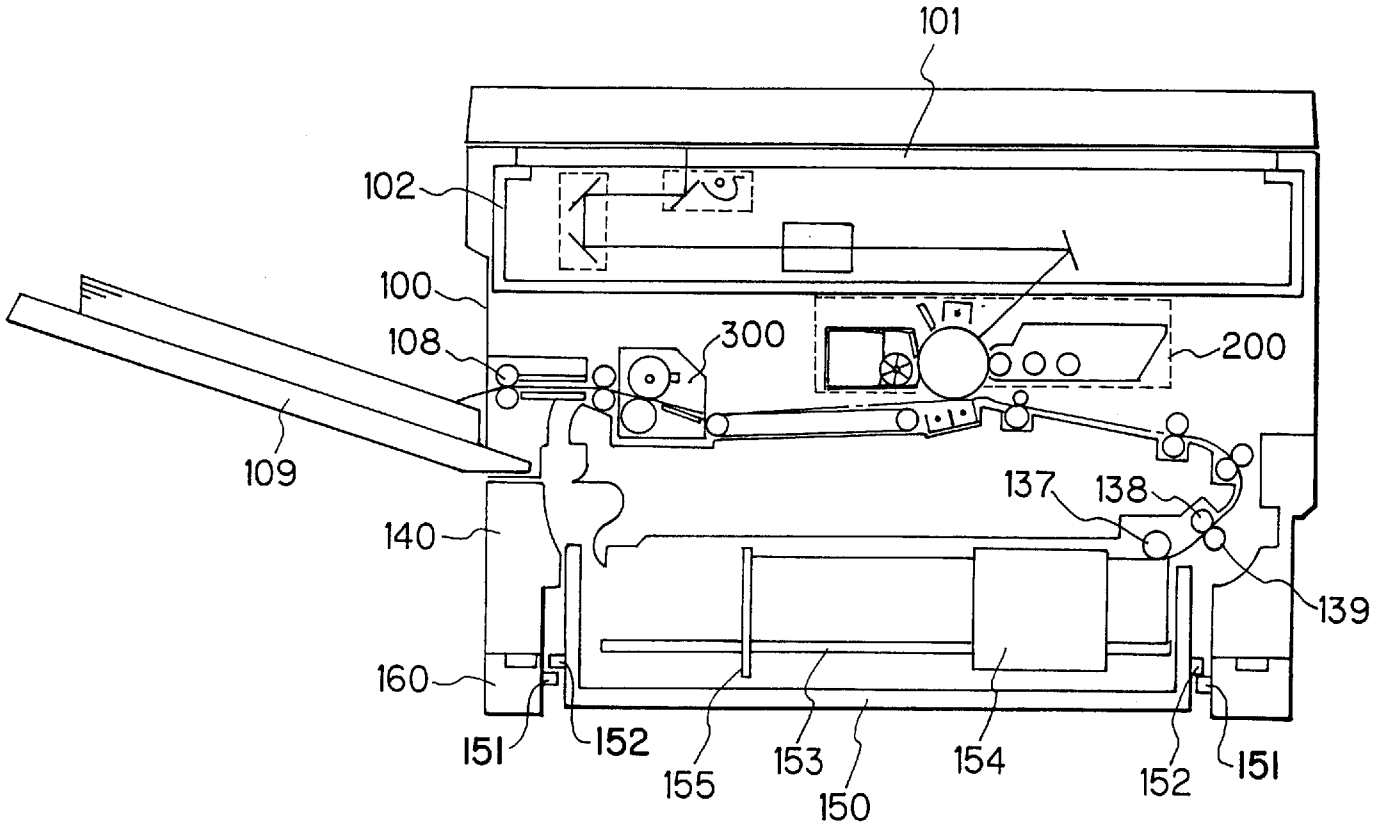
FIG. 7 is an overall configurational diagram schematically showing an image forming apparatus having a large volume sheet tray unit in accordance with an embodiment of the invention.
Figure 8:
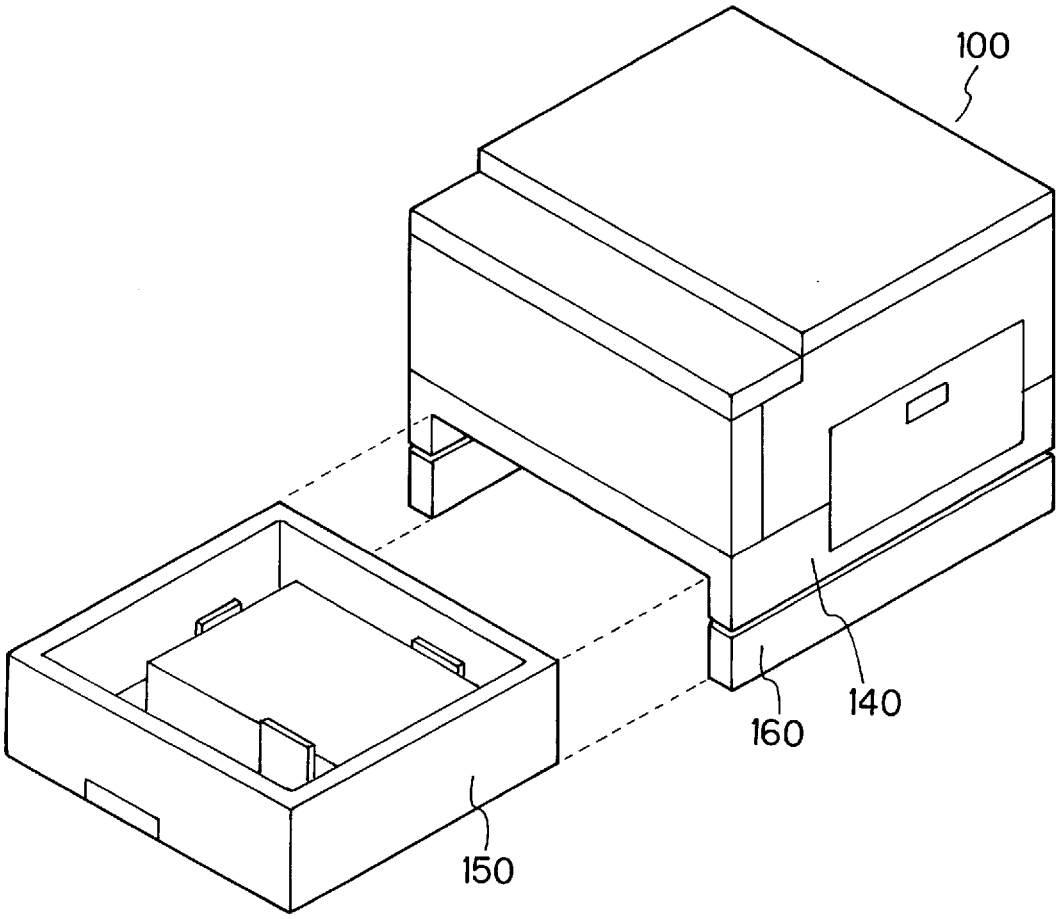
FIG. 8 is a perspective view showing how the large volume sheet tray unit is fitted into the aforementioned image forming apparatus.
Figure 9:
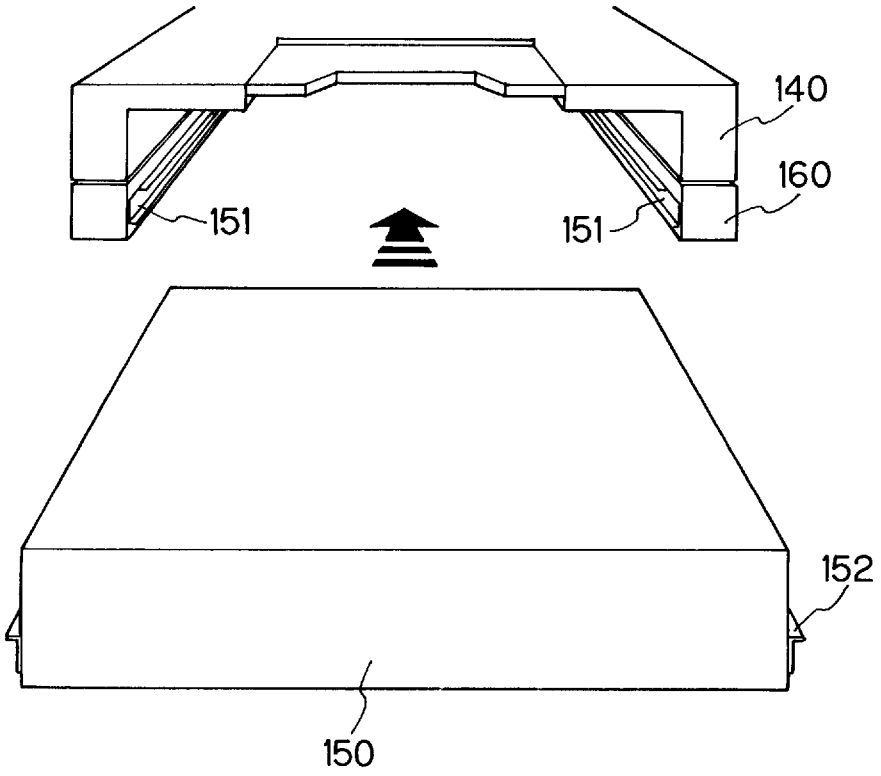
FIG. 9 is a perspective view showing the positions of rails along which the large volume sheet tray unit is fitted into the aforementioned image forming apparatus.
Figure 10:
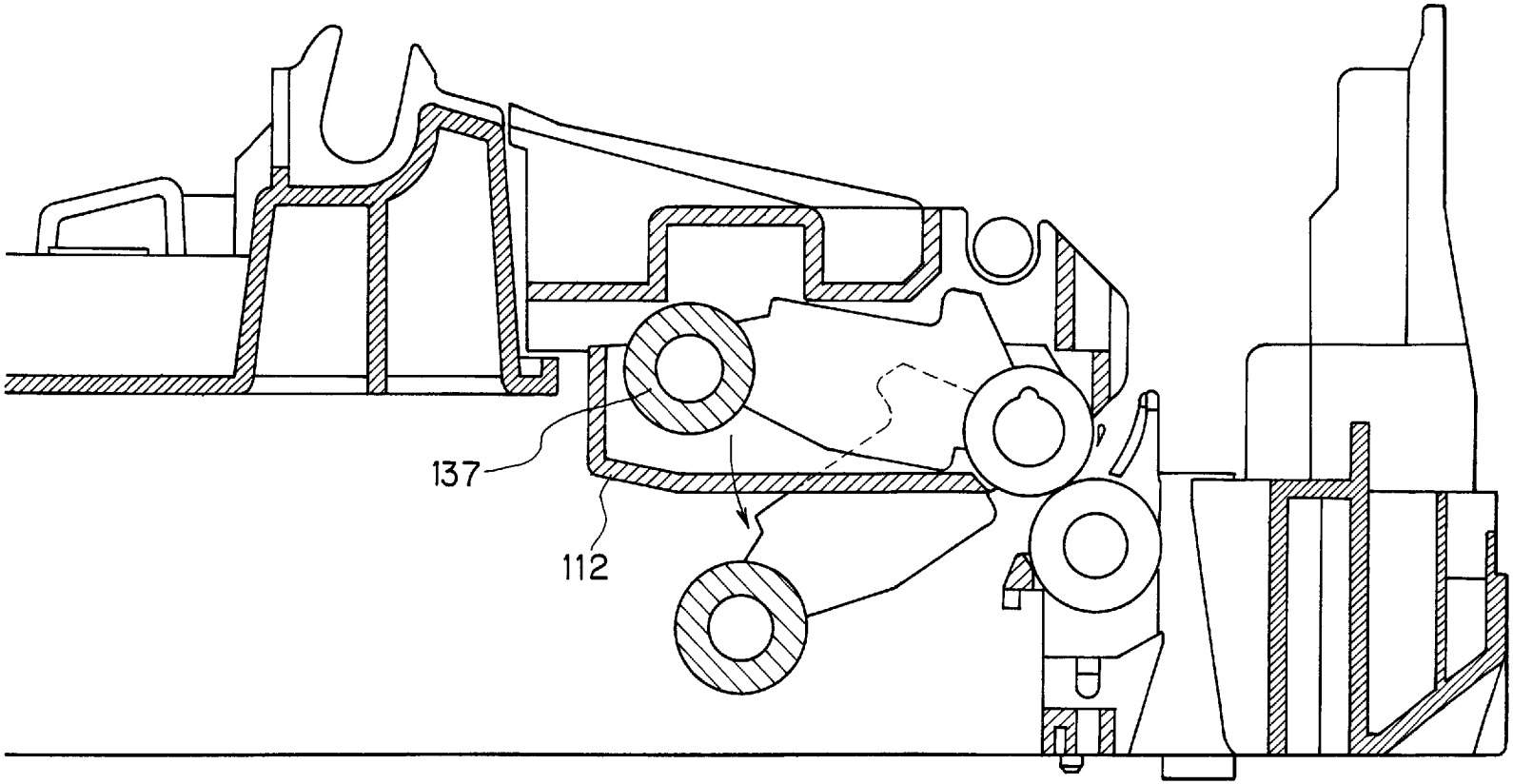
FIG. 10 is a sectional view showing a pickup roller for feeding sheets and a covering portion for covering the pickup roller, arranged in the aforementioned image forming apparatus.

As shown in FIGS. 7 through 9, image forming apparatus body 100 is designed so that sub-frame 160 can be integrally joined and fixed as an option to base frame 140 on both sides of image forming apparatus body 100. This sub-frame 160 in addition to the space which has been occupied by small volume sheet tray unit 130, creates a greater storage space for allowing a large volume sheet tray unit 150, which needs a larger storage space than small volume sheet tray unit 130, to be detachably fitted thereinto. FIG. 9 is a perspective view showing how large volume sheet tray unit 150 is fitted to image forming apparatus body 100.

Next, the configuration of large volume sheet tray unit 150 will be explained in detail.

Large volume sheet tray unit 150 is designed so as to be fitted into the place in image forming apparatus body 100 from which duplex printing tray unit 110 has been drawn along its rails. Since large volume sheet tray unit 150 has, in order to accommodate a large volume of sheets, a greater depth than the frame of small volume sheet tray unit 130, it has a pressure plate 153 which can move sheets upwards in parallel instead of a pressure plate of small volume sheet tray unit 130. Pressure plate 153 urges the sheets placed thereon toward pickup roller 137 so as to put the sheets in contact with the pickup roller, thus allowing the sheets to be fed.

Large volume sheet tray unit 150 has a pair of projections 152 disposed on the left and right sides of the frame thereof. These projections engage rails 151 of sub-frame 160. The unit 150 further has a width adjuster plate 154 and rear end adjuster plate 155, which are provided movably in accordance with the size of the sheets to be stored and keep the stored sheets in place.

The sheets stored in large volume sheet tray unit 150 are delivered out sheet by sheet by pickup roller 137 toward a pair of rollers, i.e., feed roller 138 and separation roller 139 and are separated and conveyed sheet by sheet.

Other than these three different kinds of functional units, namely duplex printing tray unit (110 in FIG. 3), small volume sheet tray unit (130 in FIG. 4) and large volume sheet tray unit 150 in FIG. 7), it is possible to fit a sheet output tray having a stapler which securers sheets by means of staples, into the accommodation site of image forming apparatus body 100.

Next, with reference to FIGS. 7, 11 and 12, description will be made of how to join and fix sub-frame 160 to base frame 140 of the image forming apparatus.

Figure 11:
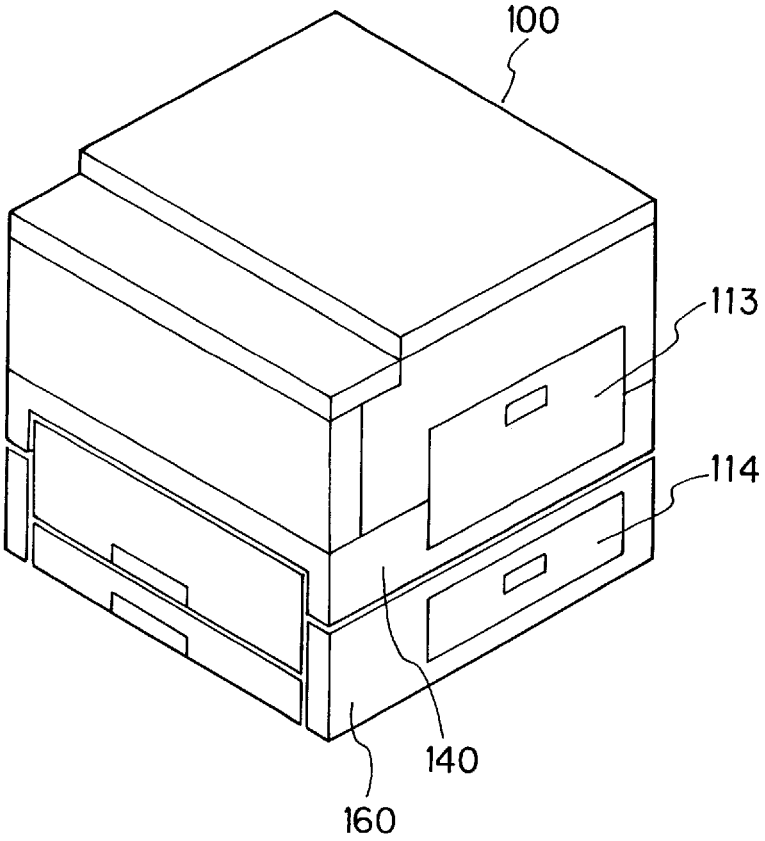
FIG. 11 is an overall perspective view showing a jam-removal panel provided in the aforementioned image forming apparatus.

As shown in FIG. 11, base frame 140 of image forming apparatus body 100 has a panel 113 for removal of sheet jams and sub-frame 160 has a panel 114 for removal of sheet jams. These panels are opened when a sheet has jammed inside the sheet conveyance path and lend themselves to removal of a sheet that has jammed. Panel 113 which is provided in base frame 140 for removal of sheet jams is also used for joining and fixture of base frame 140 of the image forming apparatus and sub-frame 160.

Figure 12:
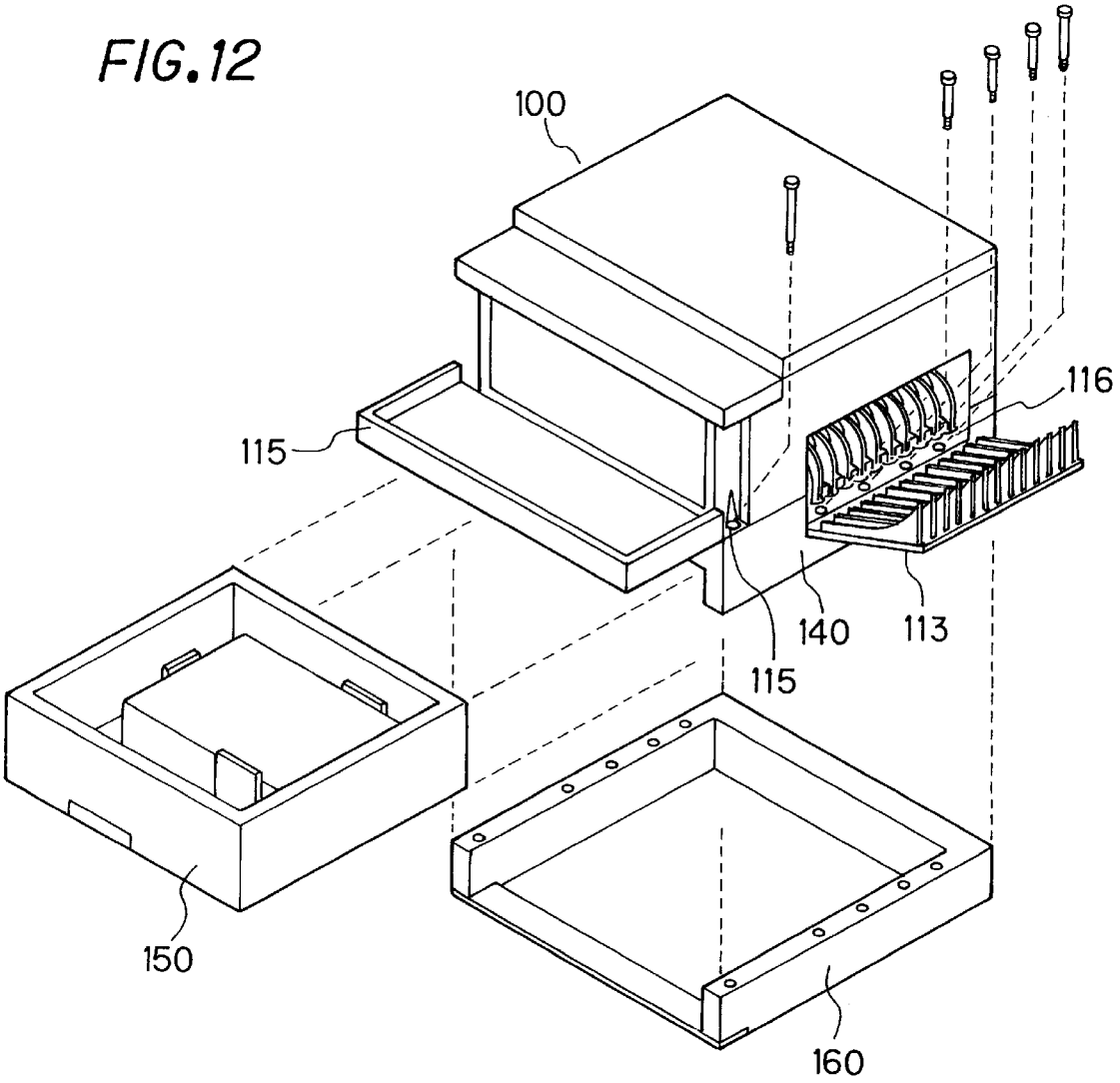
FIG. 12 is an exploded perspective view for illustrating a method of joining and fixture of the base frame and a sub-frame in an image forming apparatus.

As shown in FIG. 12, when sub-frame 160 is joined and fixed to base frame 140 of the image forming apparatus, with front panel 115 of the image forming apparatus and jam-removal panel 113 provided in base frame 140 open, screws are fixed to sub-frame 160 through passage holes 116 aligned near the hinge of front panel 115 and along the hinge of jam-removal panel 113. In this way, sub-frame 160 and base frame 140 of the image forming apparatus are joined and fixed in the vertical direction.

Figure 13:
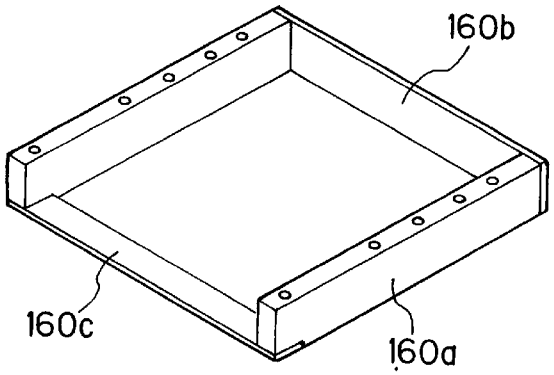
FIG. 13 is a perspective view showing another sub-frame.

As shown in FIG. 13, sub-frame 160 is composed of a pair of side wall portions 160*a* of rectangular bars constituting the parts joined to the sides of base frame 140 of image forming apparatus body 100, a rear panel 160*b* connected to the rear of side wall portions 160*a*, and a front bottom plate 160*c* connected to the front undersides of side wall portions 160*a*, and is assembled by attaching rear panel 160*b* and front bottom plate 160*c* to side wall portions 160*a*.

Accordingly, when large volume sheet tray unit 150 is not attached, sub-frame 160 can be disassembled into and tidied away as rectangular bar-shaped side wall portions 160*a*, plate-like rear panel 160*b* and front panel 160*c*, providing a convenient, or space-saving configuration for storage.

Another assembling method will be explained with reference to FIGS. 14A to 14C.

Figure 14A:
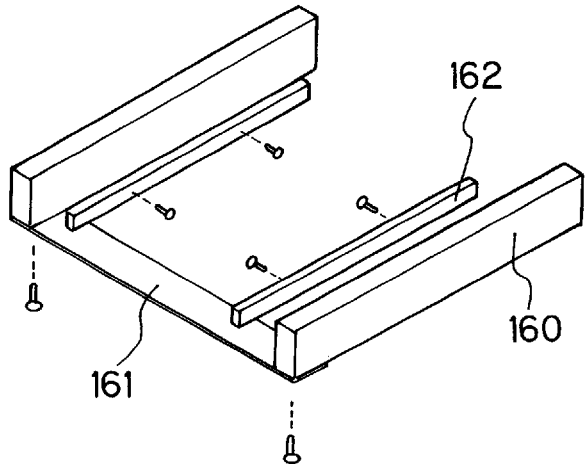
FIGS. 14A to 14C are perspective views for illustrating a method of joining and fixture of another base frame and a sub-frame in an image forming apparatus.
Figure 14B:
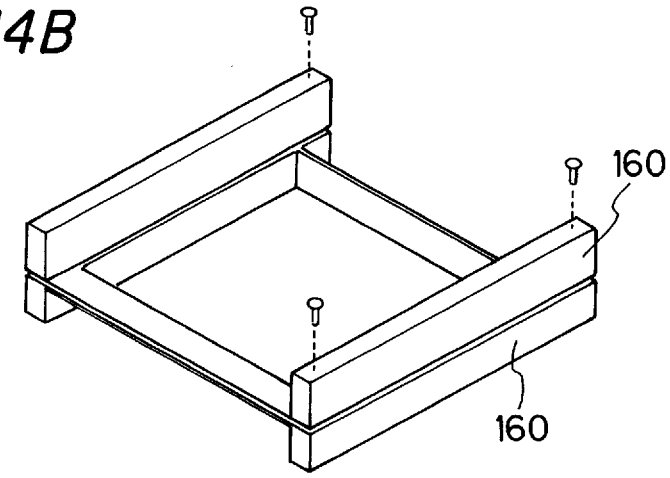
Figure 14C:
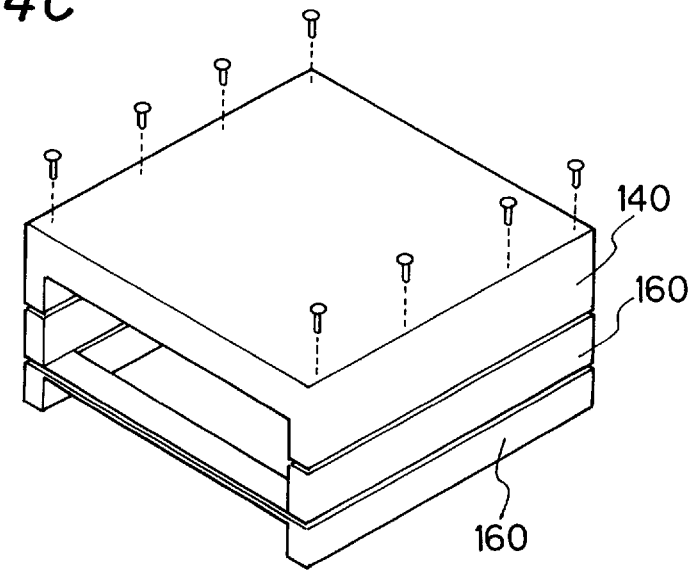

A metal sheet 161 is placed and fixed by screws on the front underside of sub-frame 160 and a pair of rails 162 are placed and fixed by screw fitting to the inner side walls of the sub-frame 160 (FIG. 14A). Another sub-frame 160 is placed and fixed by screws on metal sheet 161 fixed under the first sub-frame 160 (FIG. 14B). Finally, the whole assembly of sub-frames 160 and base frame 140 of the image forming apparatus are aligned with each other and fixed together by screw fitting (FIG. 14C).

Figure 15:
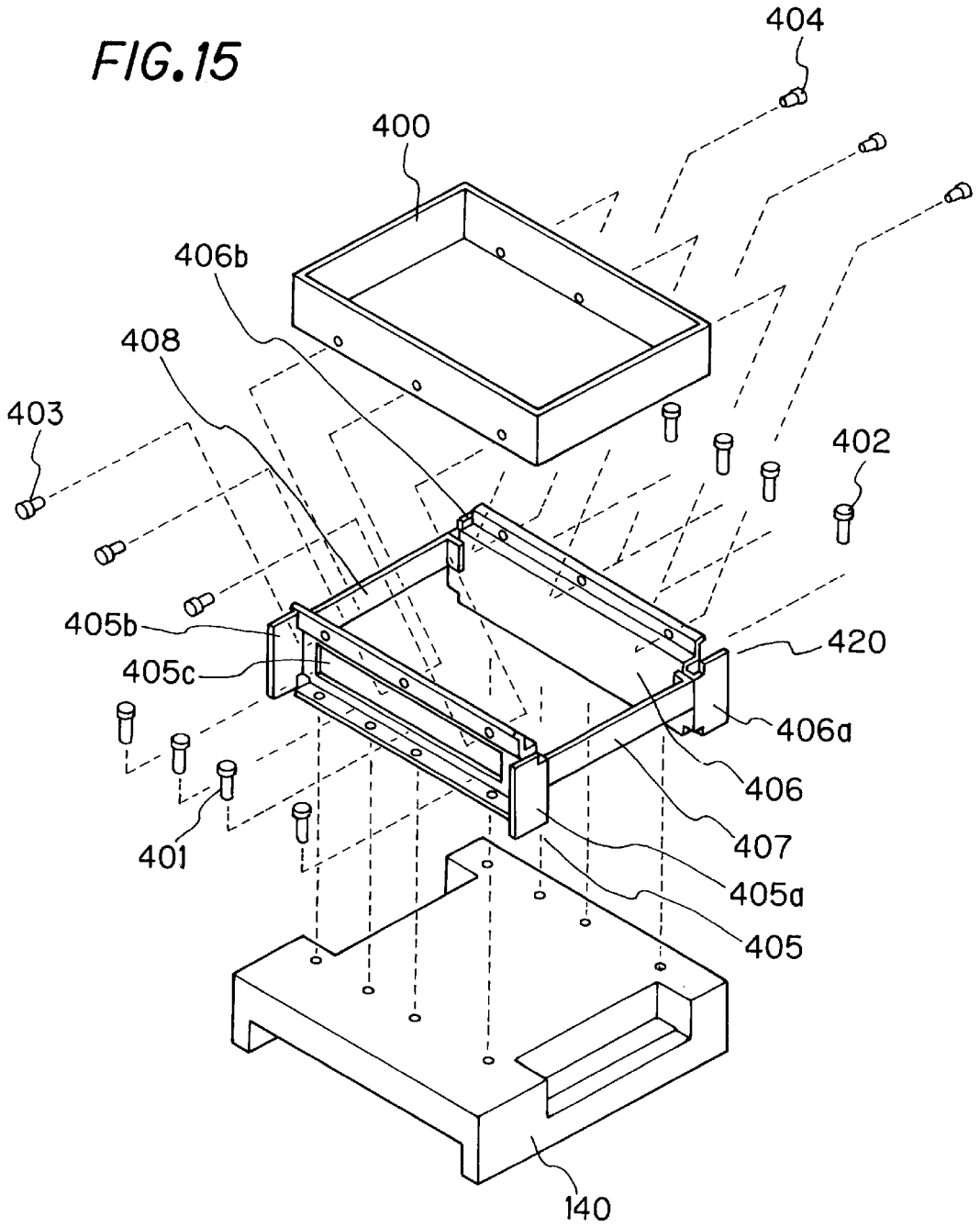
FIG. 15 is an exploded perspective view for illustrating the method of assembling separate frames into a composite frame for an image forming apparatus.

Next, frame components forming a complex frame will be described with reference to FIG. 15.

Provided inside the image forming apparatus are various functional units; there are frames for holding and accommodating these functional units inside the machine. The frames inside the apparatus are generally large. These large frames, in particular, include an original scanner unit frame 400, support frame 420 and base frame 140. These frames are joined to each other by fixture means 401, 402, 403 and 404 enhancing the rigidity of the entire image forming apparatus.

Now, these frames will be explained.

Original scanner unit frame 400 is formed by shaping a sheet metal by bending, drawing and/or other methods into a box-like structure with a high degree of rigidity, so as to accommodate optical components which need to be positioned with high accuracy.

Support frame 420 is composed of front and rear frames 405 and 406, which both are formed by shaping sheet metal by bending, drawing and/or other methods, and connecting plates 407 and 408. These components are put together by fixture means such as screw fitting etc., or welding means such as spot welding etc. Front frame 405 has a large opening 405*c* which allows image forming unit 200 to be attached and removed, fixing unit 300 to be drawn out and jammed sheets to be removed from the sheet conveyance path.

Rear frame 406 holds driver sources such as motors etc. for supplying driving force and/or electric power to the functional units, drive transmission parts such as gears, belt etc., and various functional units or functional parts such as a DC power board, AC power circuit, high-voltage power circuit, etc.

Further, front frame 405 and rear frame 406 have bent portions 405*a*, 405*b*, 406*a* and 406*b* which bend toward the sides of the image forming apparatus and are provided to hold side exterior panels of the image forming apparatus and functional parts.

Base frame 140 is disposed at the bottom of the image forming apparatus body and other frames and functional units etc. all are placed thereon. Because this base frame 140 is used for various purposes such as securing fixing unit 300 thereon, detachably accommodating sheet tray unit 130 therein, holding conveyer functional parts and further constituting part of the sheet guides, it has a complicated structure, needing strength. For these reasons, the base frame is formed of an integral resin molding.

The reason the frame of the image forming apparatus is made up of various frames of different materials in combination, is to make use of the properties of the materials to improve the utilities of the frames. For example, base frame 140, in general, tends to have a complicated configuration and needs rigidity across its area in the thickness direction. If this is formed of sheet metal, the metal needs to be bent, drawn and/or welded, increasing the number of production steps and needing an increased number of dies as well as more parts. This is why the base frame is made of resin material.

On the other hand, front frame 405 and rear frame 406 are configured with a sheet metal in order to reduce the depth of the copier, in order to support driver functional parts such as bosses for gears etc., and in order to create high-accuracy mutual positional relationship between original scanner unit 102 and image forming unit 200. In this way, the frame described above detachably accommodates functional units, fixes the frames of fictional units, fixes and accommodates functional units and holds functional parts.

An image forming apparatus of the first feature of the invention, is made up of a plurality of functional units assembled in combination, includes: a main frame having an accommodating portion having a predetermined accommodation space for accommodating a first functional unit, and is constructed such that when a second functional unit which requires a greater accommodation space than that of the first functional unit is accommodated, a sub-frame which creates a greater accommodation space of the accommodating portion of the main frame for accommodating the second functional unit is jointed and fixed integrally to the main frame.

This configuration attains two diverse objects, i.e., easy addition of new functions and avoidance of a large frame. That is, it is possible to easily add new functions without needing various types of large frames. For example, it is possible to easily add a new function to an already purchased image forming apparatus, and it is also possible to improve the design efficiency for developing a series of models having the same base machine of an image forming apparatus with some particular different portions.

An image forming apparatus of the second feature of the invention, is constructed such that the first functional unit is a sheet storage tray for holding sheets and the second functional unit is a duplex printing tray unit.

This configuration allows the main frame to be used for the sheet storage tray and duplex printing tray unit, and can minimize the sheet conveyance path for duplex printing so that the job speed of duplex printing can be made higher than that when the duplex printing tray unit is attached to any other site. Further, without the necessity to change the main frame, it is possible to easily add the function of duplex printing to machines already on the market, maximizing the speed of the operation of duplex printing.

An image forming apparatus of the third feature of the invention is constructed such that the sub-frame is joined integrally to the main frame of the image forming apparatus body, and when the duplex printing tray unit is attached thereto, an accommodation space for accommodating a sheet storage tray is formed below the duplex printing tray unit.

This configuration enables integrated use of the duplex printing tray unit and sheet storage tray, therefore it is no longer necessary to provide another frame for accommodating a sheet storage tray when a duplex printing function maximized in its duplex printing speed is added to an already released machine on the market.

An image forming apparatus of the fourth feature of the invention is constructed such that the sub-frame is formed by assembling side wall portions which are formed of rectangular bars and are connected to the sides of the main frame of the image forming apparatus body, with a rear side plate which is connected to the rear ends of the side wall portions.

In general, a frame for accommodating large units such as sheet storage units would make the machine's foot print larger which means an enlargement in two dimensional direction. But this configuration enlarges the machine only in one direction, i.e. in height. Therefore, the machine can be easily carried when additional functions are added to a machine already on the market. Further, concerning storage of the parts on the production line, frames can be produced for each individual unit, needing a minimum space for storage. Moreover, since the sub-frame is formed by parts of extremely simple shapes, i.e., rectangular-bar shaped plates, packaging it for transport becomes simple.

An image forming apparatus of the fifth feature of the invention is constructed such that when the sub-frame is joined to the main frame of the image forming apparatus body, with an openable front panel and sheet jam removal panel provided in the image forming apparatus body both open, the main frame and sub-frame are jointed in the vertical direction along the side of the panel hinges.

When the sub-frame is fixed to the main frame from the side thereof, this structure presents a poor strength in the horizontal direction though the strength of joint in the vertical direction is adequate. Further, since the frame also serves as the exterior, the appearance is degraded. On the other hand, when the sub-frame is fixed to the main frame so that each frame abuts the other frame, it is possible to provide strength in both the vertical and horizontal directions to a high enough degree. Therefore, this configuration increases the rigidity across the composite frame structure, and is suitable for the frame which is positioned at the bottom and supports the weight on the top thereof. Further, since only the joints appear between the main frame and the sub-frame, the appearance is enhanced. Moreover, since the main frame and sub-frame can be joined and fixed by opening the jam-removal panel and front panel of the image forming apparatus body, which both are easily opened without using tools, the fixture can be made from above, which is simpler as compared to the configuration where the work of joining has to be carried out by disassembling the front panel.

An image forming apparatus of the sixth feature of the invention is constructed such that when the sub-frame has been integrally joined to the main frame of the image forming apparatus body and the duplex printing tray unit has been attached thereto, a sheet conveyance path for allowing the sheet with one side printed to proceed to the duplex printing tray unit is provided in the image forming apparatus body.

Since the sheet conveyance path for allowing the sheet with one side printed to proceed to the duplex printing tray unit is provided inside the image forming apparatus, it is possible to easily attach and use the duplex printing tray unit in place of the sheet storage tray.

An image forming apparatus of the seventh feature of the invention is constructed such that when the sub-frame has been integrally joined to the main frame of the image forming apparatus body and the duplex printing tray unit has been attached thereto, the surface of the cover for the pickup roller constitutes part of the guide surface for the duplex conveyance path of the sheet which is discharged from the duplex printing tray unit.

This configuration does not necessitate disassembly of the pickup roller of the sheet storage tray when the function of duplex printing is added to a machine already on the market, therefore it is possible to easily add the function of duplex printing.

What is claimed is:

1. An image forming apparatus made up of a plurality of functional units assembled in combination, comprising:

a main frame having an accommodation portion having a predetermined accommodation space for accommodating a first functional unit, wherein when a second functional unit which requires a greater accommodation space than that of the first functional unit is accommodated, a sub-frame which creates a greater accommodation space of the accommodating portion of the main frame for accommodating the second function unit is jointed and fixed integrally to the main frame;

wherein the first functional unit is a sheet storage tray for holding sheets; the second function unit is a duplex printing tray unit; and a sub-frame for accommodating the second functional unit is joined and fixed integrally to the main frame.

2. The image forming apparatus according to claim 1, wherein the sub-frame is joined integrally to the main frame of the image forming apparatus body, and when the duplex printing tray unit is attached thereto, an accommodation space for accommodating a sheet storage tray is formed below the duplex printing tray unit.

3. The image forming apparatus according to claim 1, wherein the sub-frame is formed by assembling side wall portions which are formed of rectangular bars and are connected to the sides of the main frame of the image forming apparatus body, with a rear side plate which is connected to the rear ends of the side wall portions.

4. The image forming apparatus according to claim 1, wherein when the sub-frame is joined to the main frame of the image forming apparatus body, with an openable front panel and sheet jam removal panel provided in the image forming apparatus body both open, the main frame and sub-frame are jointed in the vertical direction along a side of panel hinges.

5. The image forming apparatus according to claim 1, wherein when the sub-frame has been integrally joined to the main frame of the image forming apparatus body and the duplex printing tray unit has been attached thereto, a sheet conveyance path for allowing the sheet with one side printed to proceed to the duplex printing tray unit is provided in the image forming apparatus body.

6. The image forming apparatus according to claim 1, further comprising a pickup roller for sheet storage tray having a cover therefor, wherein when the sub-frame has been integrally joined to the main frame of the image forming apparatus body and the duplex printing tray unit has been attached thereto, a surface of the cover for the pickup roller constitutes part of a guide surface for a duplex conveyance path of a sheet which is discharged from the duplex printing tray.

* * * * *